US007086357B2

(12) United States Patent
Mac Vicar et al.

(10) Patent No.: US 7,086,357 B2
(45) Date of Patent: Aug. 8, 2006

(54) CYLINDER HEAD WITH IMPROVED HEAT TRANSFER AND VALVE SEAT COOLING

(75) Inventors: Robert T. Mac Vicar, Downers Grove, IL (US); Vijaya Kumar, Darien, IL (US); John R. Zagone, Westmont, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 6 days.

(21) Appl. No.: 11/041,663

(22) Filed: Jan. 24, 2005

(65) Prior Publication Data

US 2005/0193966 A1 Sep. 8, 2005

Related U.S. Application Data

(60) Provisional application No. 60/550,114, filed on Mar. 4, 2004.

(51) Int. Cl.
*F02F 1/36* (2006.01)

(52) U.S. Cl. ..... 123/41.82 R; 123/41.77; 123/41.31; 123/193.5

(58) Field of Classification Search ..... 123/41.82 R, 123/41.77, 41.31, 195.5
See application file for complete search history.

(56) References Cited

U.S. PATENT DOCUMENTS 3,081,755 A * 3/1963 Kotlin et al. ..... 123/41.77
3,377,996 A 4/1968 Kotlin et al.
4,860,700 A 8/1989 Smith

* cited by examiner

*Primary Examiner*—Henry C. Yuen
(74) *Attorney, Agent, or Firm*—Cook, Alex, McFarron, Manzo, Cummings & Mehler, Ltd.

(57) ABSTRACT

An improvement to a diesel engine cylinder head disclosed in U.S. Pat. No. 4,860,700, wherein the improvement comprises any of: a by-pass opening formed in partition walls thereof; a spine density of less than about five spines per square inch; spacing an inner chamber wall surface thereof with respect to an inner fire-face wall surface thereof between about 0.75 inches and 0.25 inches; coolant by-pass ports thereof having a cross-section of between about 0.1875 inches and 0.0625 inches; and a radial rib thereof extending complete and free of any rib opening.

19 Claims, 7 Drawing Sheets

CYLINDER HEAD WITH IMPROVED HEAT TRANSFER AND VALVE SEAT COOLING

CROSS-REFERENCE TO RELATED APPLICATIONS

The present patent application claims the benefit of U.S. Provisional Ser. No. 60/550,114, filed on Mar. 4, 2004.

TECHNICAL FIELD

The present invention relates to internal combustion diesel engines, and more particularly to a cylinder head improved over that disclosed in U.S. Pat. No. 4,860,700, wherein a plurality of consequential modifications provide improved heat transfer and valve seat cooling with respect to circulating coolant of a coolant system of the engine.

BACKGROUND OF THE INVENTION

An internal combustion diesel engine cylinder head of interest is disclosed in U.S. Pat. No. 4,860,700 to Smith, issued on Aug. 29, 1989 and assigned to the assignee of the present patent application, wherein the entire disclosure of said U.S. Pat. No. 4,860,700 is hereby herein incorporated by reference. In that the present invention is an improvement to the diesel engine cylinder head disclosed in said U.S. Pat. No. 4,860,700, a description of the disclosure thereof is generally presented hereinbelow with attention being directed to FIGS. 1 through 8.

Referring now to the drawings, the diesel engine cylinder head of U.S. Pat. No. 4,860,700 will be generally described. Numeral 10 generally indicates a cylinder head of the general type shown in U.S. Pat. No. 3,377,996 Kotlin et al, but having significant differences in the cooling water jacket structure as will be subsequently more fully described. The cylinder head embodiment disclosed when assembled with the usual valve mechanism, not shown, is primarily intended for use in a uniflow scavenged two-cycle engine of the fuel injection compression ignition type and is adapted to be secured in end sealing engagement to the upper end of a jacketed liquid cooled cylinder liner and to be mounted therewith in a cylinder mounting bore of an engine frame member wherein the cylinder head 10 cooperates with a piston reciprocably mounted in the liner to define an expansible combustion chamber therebetween.

The cylinder head 10 comprises a lower combustion chamber defining fire-face wall 12 engageable outwardly with the upper end of the associated jacketed liner. An upper head wall 14 extends in spaced parallel relation to the fire-face wall 12 and is connected thereto by a peripheral boundary sidewall 16. A flange 18 is coextensive with and extends upwardly and outwardly of the upper head wall 14 and the sidewall 16 to provide an annular shoulder 20. In mounting the cylinder assembly, this flange defined shoulder of the cylinder head is engageable with a mating shoulder provided therefor in the engine frame.

The sidewall 16 and flange 18 are structurally reinforced by a plurality of spaced vertically extending stud bosses 22, 23, 24, 25, 26, 27, 28 and 29. The stud bosses 22–29 define a plurality of stud holes 30 which are adapted to receive therethrough studs for securing the cylinder head to the jacketed cylinder liner. The upper head wall and fire-face wall are interconnected centrally of the cylinder head by a sleeve defining wall portion 32. The sleeve defining wall portion 32 provides a central opening 33 extending through the cylinder head which is of stepped and tapered diameters and is adapted to mount a suitable fuel injection device.

Four valve seat defining exhaust ports 34 extend through the fire-face 12 of the head in equispaced relation about the sleeve defining wall portion 32. The exhaust ports 34 communicate upwardly through short branch passages 35, 36, 37 and 38 with a common exhaust passage or chamber 39. The branch passages are defined by exhaust port wall portions 41, 42, 43 and 44 which extend upwardly between the fire-face wall 12 and a horizontal chamber wall 45. The chamber wall 45 extends inwardly from the sidewall 16 in spaced parallel relation above the fire-face wall 12, wherein an inner chamber wall surface 45*a* thereof faces an inner fire-face wall surface 12*a* of the fire-face wall, and terminates inwardly at its intersection with the sleeve defining wall portion 32. Four webs or partition walls 46 are provided extending vertically between the fire-face wall 12 and the chamber wall 45 and laterally between each of the exhaust port wall portions 41, 42, 43, 44 and the adjacent stud bosses 23, 24, 27 and 28, respectively, which connect with the sidewall 16

The exhaust passage 39 is defined between the chamber wall 45 and an upper passage wall 47. The upper passage wall 47 is structurally connected to the upper head wall 14 by four tubular or cylindrical wall portions 48 which extend therebetween in axial alignment with the several valve seating ports 34 and define bores 49 adapted to receive suitable valve guide bushings.

As is best seen in FIGS. 2 and 5, the exhaust passage 39 extends arcuately of the head, partially embracing the sleeve defining wall portion in spaced relation thereto and intersecting the several valve controllable branch passages 35–38, and communicates laterally outwardly with an exhaust outlet port 50 opening through the sidewall 16 of the head. The outlet port 50 is connectable to an exhaust manifold through a suitable branch passage which may be provided in the engine frame. The outlet port is vertically intersected by two struts 51 and 52. These struts are coextensive with stud bosses 22 and 29 respectively and each has a passage 54 extending therethrough. The passages 54 permit the circulation of a coolant (i.e., cooling fluid) through the gas exposed struts 51 and 52.

It will be seen that the chamber and exhaust passage defining walls cooperate with the outer walls of the cylinder head to define a coolant-receiving compartment. This compartment is divided by the horizontal chamber wall 45 into a lower jacket chamber 55 and an upper jacket chamber 56. The lower jacket chamber 55 is divided by the partition walls 46 into four sections 58, 59, 60 and 61 which are alternately outlet and inlet sections that are interconnected by restricted passages 62 formed between the exhaust port wall portions 41, 42, 43 and 44 and the sleeve defining wall portion 32.

The upper and lower jacket chambers are interconnected through various openings in chamber wall 45 adjacent the inner periphery of sidewall 16. The primary connection is through a pair of relatively large passages 64 extending from the outlet sections 58 and 60 of the lower chamber upwardly past the upper exhaust passage wall 47 to the upper chamber. The chambers are also connected through four small openings or coolant by-pass ports 65 connecting with inlet section 59 and passages 54 in struts 51 and 52 which connect with inlet section 61 of the lower chamber.

The coolant is forced or drawn upwardly into the cylinder head through twelve inlet ports extending through and spaced around the fire-face wall 12 adjacent sidewall 16. Eight of these are relatively large coolant inlet ports 66 which open into inlet sections 59 and 61 of the lower chamber while four are relatively small coolant inlet ports 68 opening into outlet sections 58 and 60 of the lower chamber. The coolant inlet ports 66 and 68 mate with corresponding coolant ports provided in the jacketed cylinder liner structure which is connected in a conventional manner to the discharge of a coolant circulation pump. As shown in FIG. 1, the upper flange portion 18 has an outlet passage 69 opening inwardly on the upper chamber 56 and outwardly on a machined face 70 thereof. This outlet passage is connectable through a suitable fitting through coolant outlet manifold to the inlet of the coolant circulation pump in a conventional manner so that forced circulation of coolant through the cylinder head is provided.

In order to increase cooling efficiency in the critical combustion surface areas of the fire-face wall 12, a plurality of cooling spines 71 are disposed on the inner fire-face wall surface 12*a* thereof, which are distributed among the four sections of the lower chamber over surface area located between the exhaust branch passages 35–38 (or the exhaust port wall portions 41–44) and extending radially outwardly therefrom. Additional web members are provided in the lower chamber for supporting the chamber wall 45 including a pair of radially directed members 72 disposed in sections 58 and 60 and a radially directed rib 74 in section 61 which intersects wall 16 and includes an opening 75 for permitting the equalization of coolant flow. Also included is a radial member 76 extending from a diagonal boss 78 which is located in section 59 and encloses a cylinder test passage 79.

The foregoing describes in substantial detail certain features of the preferred embodiment disclosed in U.S. Pat. No. 4,860,700, which are similar in construction to the arrangement of the previously mentioned U.S. Pat. No. 3,377,996. In accordance with the disclosure of U.S. Pat. No. 4,860,700 over U.S. Pat. No. 3,377,996, certain structural changes were made thereto.

As can be seen in FIG. 5 (as compared with FIG. 6 of U.S. Pat. No. 3,377,996), the partition walls 46 were modified. The change was such that at the connections of their inner ends with their respective exhaust port wall portions 41–44, the partition walls 46 lie tangent to the exhaust port wall portions 41–44 on the sides thereof facing toward the outlet sections 58, 60 of the lower jacket chamber 55.

Preferably also, as shown, the outer ends of the partition walls 46 connect with adjacent ones of the stud bosses 22–29, specifically numbers 23, 24, 27 and 28, in a manner such that they also lie tangent to these stud bosses on their sides facing toward the inlet sections 59, 61 of the lower jacket chamber. These modifications result in more nearly, though not precisely, radial orientations of the partition walls 46 as compared to the essentially parallel orientations of the prior arrangement of U.S. Pat. No. 3,377,996.

In operation in an engine having a cylinder head with coolant jacket as described, the manner and direction of coolant flow is essentially as described in U.S. Pat. No. 3,377,996. Thus, by far, the major portion of the coolant enters the cylinder head through coolant inlet ports 66 in the inlet sections 59 and 61 of the lower jacket chamber 55. The closely spaced partition walls 45 direct the coolant inwardly toward the center of the head and it sweeps completely around the peripheries of exhaust passage wall portions 41–44, passes into outlet sections 58 and 60 and out of the lower chamber through outlet ports 64 leading to the upper jacket chamber 56.

According to the disclosure of U.S. Pat. No. 4,860,700, the velocity of the coolant is accelerated due to the constricted passages between the exhaust port wall portions 41–44 as well as between the sleeve defining wall portion 32 and the various branch passage walls; the cooling spines 71, located between the branch passage walls, further accelerate the flow and increase turbulence to obtain a high degree of scrubbing action and very efficient cooling; and the small inlet openings 68, provided in sections 58 and 60, pass a very small percentage of coolant flow into the head and serve to prevent the existence of hot spots in the connected cylinder liner.

Upon passing upwardly through coolant by-pass ports 64 into the upper chamber, the coolant sweeps over the exhaust passage defining wall 47 and around the outer peripheries of the sleeve defining wall portion 32 and valve guide wall portions 48 before leaving the upper chamber through outlet passage 69. A restricted flow of coolant is also permitted to pass directly from chamber 59 through the coolant by-pass ports 65 in partition wall 45 and into the upper jacket chamber. The coolant by-pass ports 65 allow removal of coolant from the adjacent portions of the cylinder head when the engine cooling system is drained. Likewise, a small flow of coolant is permitted to pass from section 61 of the lower jacket chamber through restrictive openings 80 in passages 54 to cool the struts 51 and 52 as well as prevent stagnation in the upper chamber.

According to U.S. Pat. No. 4,860,700, the modified tangential positioning of the partition walls 46 avoids the creation of stagnant pockets of coolant, particularly on the outlet section sides of the partition walls between the exhaust port wall portions 41–44 and the outer peripheral sidewall 16, wherein the coolant flow entering the outlet sections from the passages 62 is encouraged to flow directly along the surfaces of the partition walls 46, cooling the metal surfaces by its scrubbing action and avoiding hot spots which might be caused by stagnation if the coolant was directed past recesses or pockets in the jacket construction.

In similar fashion according to U.S. Pat. No. 4,860,700, the tangent connection of the partition walls 46 with the stud bosses 23, 24, 27, 28 minimizes the formation of pockets on the inlet section sides of the partition walls and improves the access of coolant to the wall areas adjacent to the coolant inlet ports 66 located toward the edges of the inlet sections, wherein the tangential web arrangement is believed, according to U.S. Pat. No. 4,860,700, to improve the cooling action of the flowing coolant on both the inlet and outlet sides of the partition walls.

While a diesel engine configured according to the disclosure of said U.S. Pat. No. 4,860,700 has exceptionally excellent performance characteristics, as for example the two-stroke, medium speed, 2000 to 5000 HP range General Motors Corporation Electromotive Division 645 and 710 diesel engines, modifications thereto would be desirable to improve valve seat cooling and increase the fire-face wall heat transfer. If such modifications could be achieved, expected would be improved cylinder head reliability due to lower metal operating temperatures and resultant lower thermal distortion and stresses, a well as improved valve seating and reliability due to reduced valve seat temperature and a more uniform valve seat temperature.

More particularly, what is needed in the art is to address the following five problem issues associated with the foregoing disclosure contained in U.S. Pat. No. 4,860,700, to wit: (1) the partition walls 46 not providing coolant flow as described above; (2) the spines 71 not performing heat exchange as described above; (3) need for improved heat transfer to the coolant of the fire-face wall 12; (4) need to reduce coolant by-pass through the coolant by-pass ports 65 so as to increase coolant circulation in the vicinity of the exhaust port wall portions 41–44 and the sleeve defining wall portion 32; and (5) need to increase structural stiffness at the radial rib 74.

SUMMARY OF THE INVENTION

The present invention is a cylinder head improved over the cylinder head disclosed in U.S. Pat. No. 4,860,700, wherein the improvement relates to a plurality of consequential structural modifications which provide improved heat transfer and valve seat cooling.

The improved cylinder head according to the present invention is a cylinder head having structural aspects as described in U.S. Pat. No. 4,860,700 and as recounted hereinabove, wherein structural modification of consequential nature have been made thereto in order to provide improved heat transfer to the coolant and improved, uniform valve seat cooling. In this regard, there are five consequential structural modifications, as follows.

The first consequential structural modification is intended to eliminate stagnant coolant at the partition walls and to provide coolant flow all around the valve seats so as to provide more uniform valve seat cooling. In this regard, the first consequential structural modification involves a coolant by-pass opening formed in each of the partition walls adjacent the exhaust port wall portions, wherein now the coolant by-pass openings separate the partition walls from the exhaust port wall portions.

The second consequential structural modification is intended to address the inability of the densely arranged spines on the inner side of the fire-face wall to effectively transfer heat to the coolant. In this regard, the second consequential structural modification involves eliminating or loosely arranging the spines, or otherwise providing undulations on the inner side of the fire-face wall so that heat transfer to the coolant is improved.

The third consequential structural modification is intended to address the inadequacy of the coolant flow at the inner side of the fire-face wall. In this regard, the third consequential structural modification involves locating the inner chamber wall surface closer to the inner fire-face surface so that coolant flows in better relation to the inner fire-face wall surface so as to improve extraction heat therefrom.

The fourth consequential structural modification is intended to address an excessive amount of coolant bypassing to the upper jacket chamber from the lower jacket chamber, with consequent lowering of coolant flow in the lower jacket chamber through the coolant by-pass ports. In this regard, the fourth consequential structural modification involves reducing the diameter of the coolant by-pass ports to an acceptably minimum so that coolant flow in the lower jacket is improved.

Finally, the fifth consequential structural modification is intended to address structural stiffness in the area of the radial rib. In this regard, the fifth consequential structural modification involves the radial rib being extended or completed, wherein the opening therein as recounted hereinabove is eliminated, so that structural stiffness is improved which, in turn, provides an improvement of gasket reliability at the cylinder head to cylinder liner interface.

Accordingly, it is an object of the present invention to provide a cylinder head having five consequential improvements to the structural configuration of the cylinder head disclosed in U.S. Pat. No. 4,860,700.

This and additional objects, features and advantages of the present invention will become clearer from the following specification of a preferred embodiment.

DESCRIPTION OF THE PREFERRED EMBODIMENT

Figure 1:
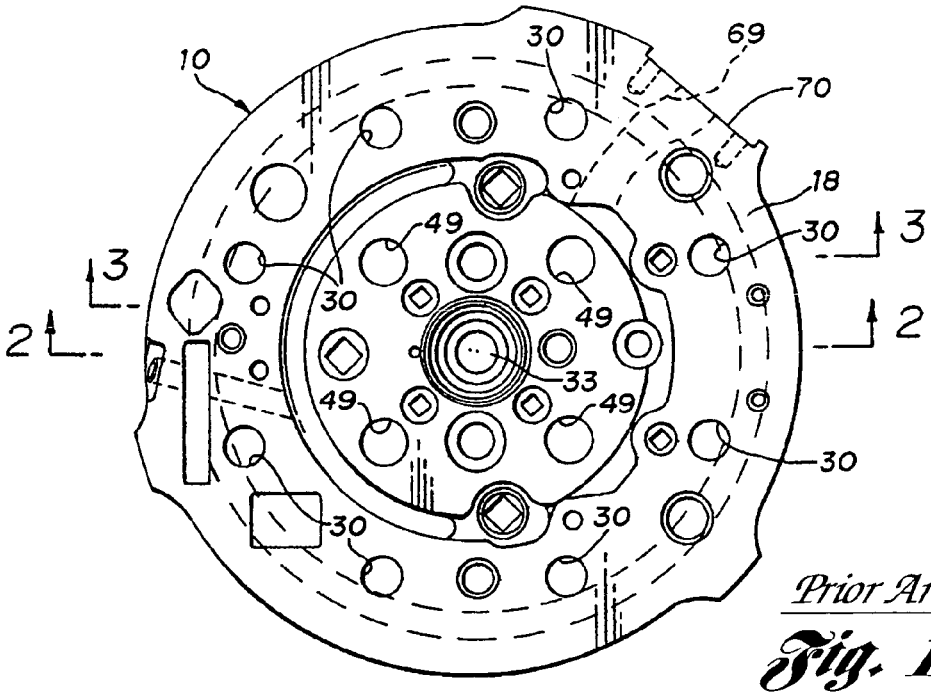
Prior Art Fig. 1
FIG. 1 is a top elevational view of a prior art cylinder head according to U.S. Pat. No. 4,860,700.
Figure 2:
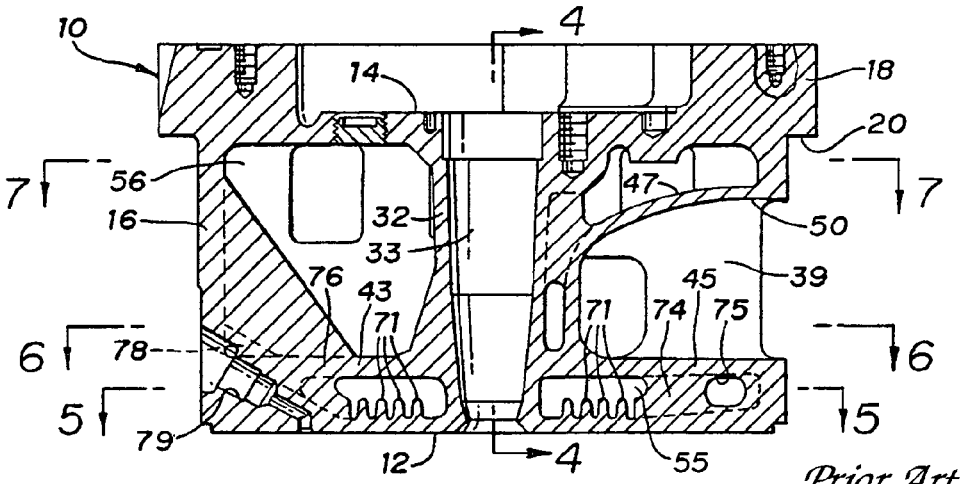
Prior Art Fig. 2
FIGS. 2 and 3 are vertical sectional views taken substantially in the planes of the lines indicated at 2—2 and 3—3 respectively of FIG. 1.
Figure 3:
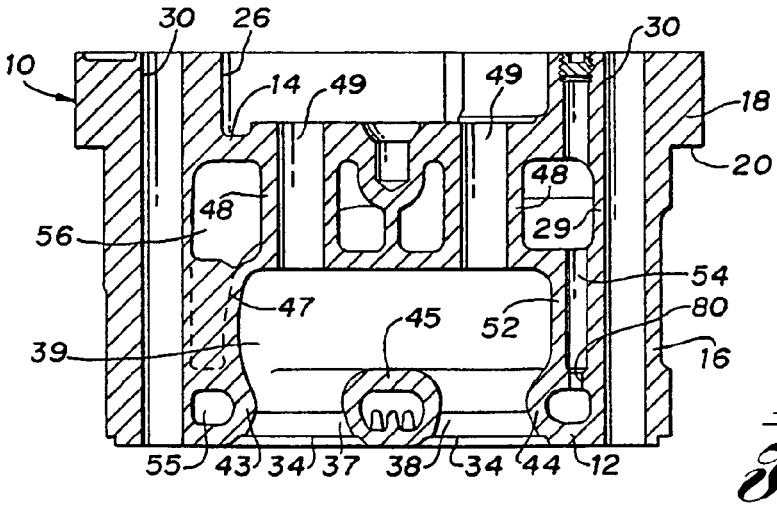
Prior Art Fig. 3
Figure 4:
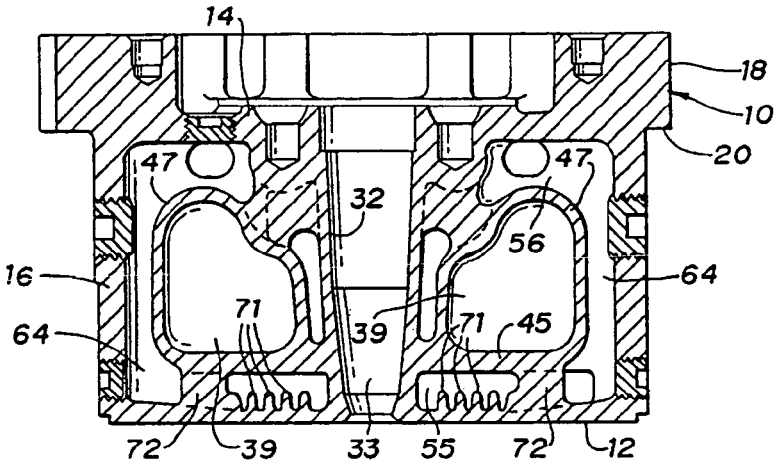
Prior Art Fig. 4
FIG. 4 is a vertical sectional view taken substantially in the plane indicated by the line 4—4 of FIG. 2.

Referring now to the drawing, FIGS. 1 through 8 depict a prior art cylinder head according to the disclosure in U.S. Pat. No. 4,860,700, and FIGS. 9 through 14 depict an improved cylinder head according to the present invention, wherein the cylinder head of the present invention involves five consequential modifications of the cylinder head of U.S. Pat. No. 4,860,700, and wherein the disclosure recounted respecting FIGS. 1 through 8 is, for the sake of brevity, incorporated hereinbelow, with like numbers representing like parts, the exceptions thereto relating to the aforesaid five consequential structural modification being as noted by the same numbers with primes or by new numbers.

Figure 8:
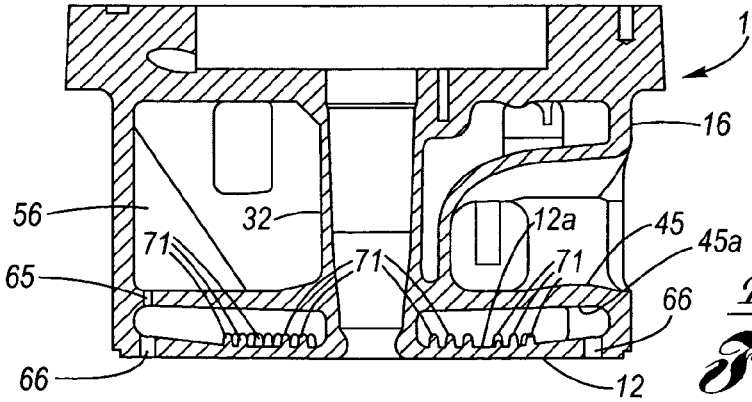
Prior Art Fig. 8
FIG. 8 is a sectional view taken along line 8—8 of FIG. 5.
Figure 9A:
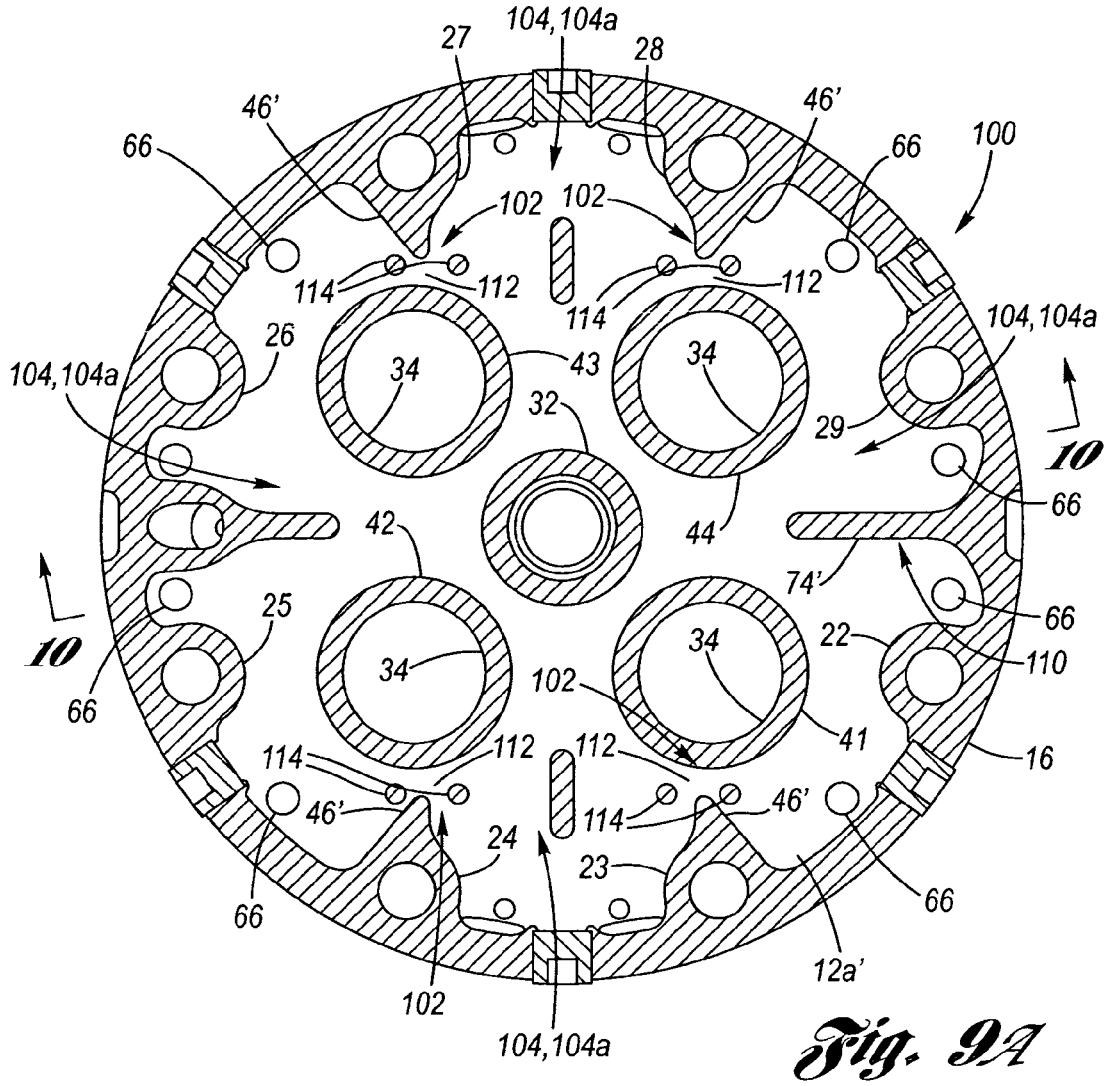
FIG. 9A is a first cross-sectional view of a cylinder head according to a first preferred embodiment of the present invention.
Figure 10:
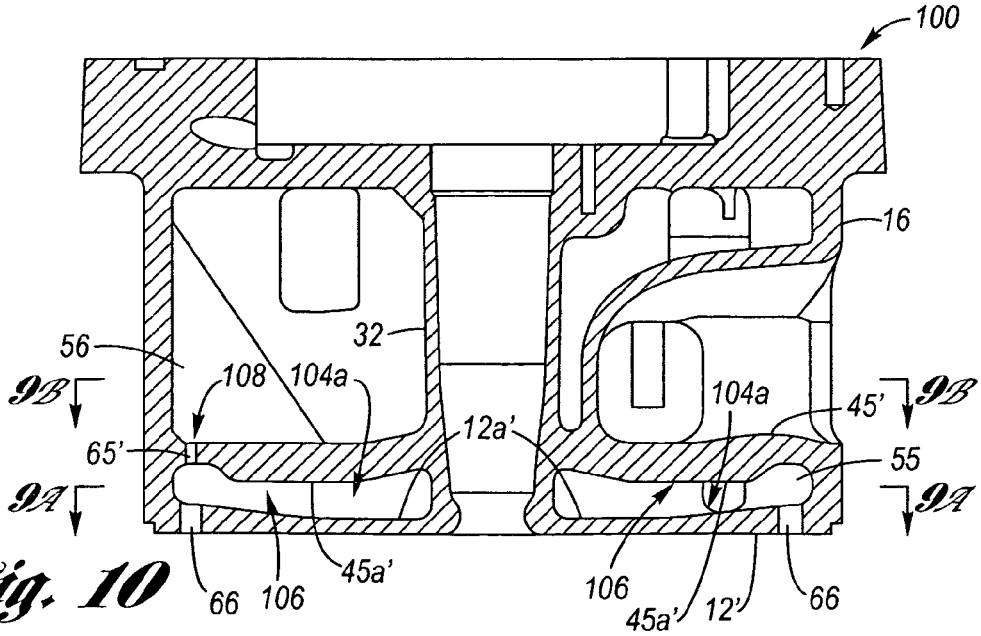
FIG. 10 is a cross-sectional view, taken along line 10—10 of FIG. 9A, wherein the sectional view of FIG. 9A is taken along line 9A—9A of FIG. 10, and wherein the sectional view of FIG. 9B is taken along line 9B—9B of FIG. 10.
Figure 9B:
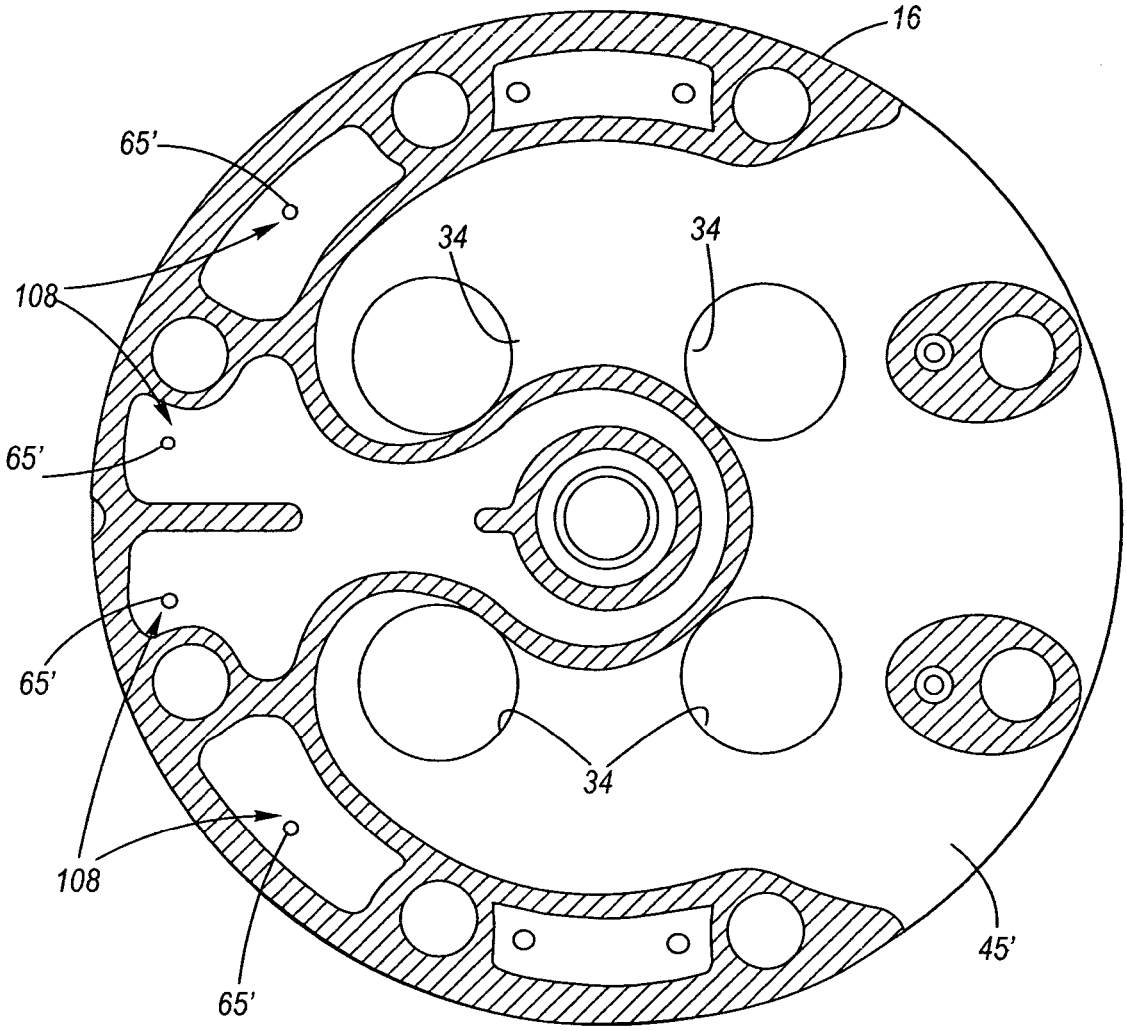
FIG. 9B is a second cross-sectional view of a cylinder head according to the present invention.

Referring to FIGS. 1 through 8, with particular reference to FIGS. 9 and 10, a first preferred embodiment of an improved cylinder head 100 is depicted, wherein the five consequential structural modifications, a first consequential modification 102, a second consequential modification 104, a third consequential modification 106, a fourth consequential modification 108, and a fifth consequential modification 110, are shown, and wherein a first aspect 104*a* of the second consequential modification 104 is depicted.

The first consequential structural modification 102 of the improved cylinder head 100 involves a coolant by-pass opening 112 formed in each of the partition walls 46' adjacent the exhaust port wall portions 41, 42, 43, 44 whereat is situated the valve seats. In this regard, the coolant by-pass openings 112 are located at the exhaust port wall portions 41–44 and serve to separate the partition walls 46' from the exhaust port wall portions 41–44 so that coolant is able to flow freely all around the exhaust port wall portions. The coolant by-pass openings 112 eliminate any possibility for stagnant coolant at the partition walls and provide coolant flow all around the exhaust port wall portions (valve seats) to provide uniform valve seat cooling.

The first consequential modification 102 may be effected any of several ways, including: when casting, including the by-pass opening in the partition walls 46'; drilling a small hole on each of the uninterrupted partition walls 46; using a fusible steel passage in the castings on each partition wall location; or any other technique to allow coolant to flow through the partition walls and thereby flow all around the exhaust port wall portions (valve seats).

By way of a second aspect 102*a* of the first consequential modification 102, a pair of obstructions 114 may be added on either side of the coolant by-pass openings 112 so as to optimize coolant flow through the coolant by-pass openings.

Continuing particular reference to FIGS. 9 and 10, the second consequential structural modification 104 of the improved cylinder head 100 involves, according to a first aspect 104*a* thereof, eliminating the spines (see 71 in FIG. 8) so that heat transfer to the coolant is improved with respect to the inner side 12*a'* of the fire-face wall 12'. In this regard, computational fluid dynamic (CFD) analysis of the cylinder head disclosed in U.S. Pat. No. 4,860,700 has shown that the spines 71 do not conduct heat from the fire-face wall to the coolant as expected. The coolant tends to flow over the densely packed spines, which prevents coolant passing in close contact with the inner fire-face wall surface 12*a,* as disclosed in U.S. Pat. No. 4,860,700, resulting in poor heat transfer from the fire-face wall to the coolant. This is overcome by eliminating the spines, as shown in FIGS. 9 and 10.

Still continuing particular reference to FIGS. 9 and 10, the third consequential structural modification 106 of the improved cylinder head 100 involves locating the inner partition wall surface 45*a'* closer to the inner fire-face wall surface 12*a'* so that coolant flows in better relation to the inner fire-face wall surface to improve extraction of heat therefrom.

The CFD analysis of the cylinder head disclosed in U.S. Pat. No. 4,860,700 also identified that the coolant flow coming from the cylinder liner through the coolant inlet ports 66 has a tendency to stay close to the inner chamber wall surface 45*a.* This can be remedied by relocating the inner chamber wall surface closer to the inner fire-face wall surface, as can be understood by comparison between FIGS. 8 and 12. As a result of this relocation, the coolant flow is forced toward the inner fire-face surface 12*a'* of the fire-face wall 12', thereby improving the transfer therefrom of heat to the coolant. Additionally, the reduced coolant flow cross-section increases in the coolant flow velocities around the valve seats and improves heat transfer therefrom to the coolant. By way of example, the cross-section between the inner chamber wall surface 45*a'* and the inner fire-face wall surface 12*a'* is about 0.89 inches in U.S. Pat. No. 4,860,700, and is about between 0.75 and 0.25 inches in the present invention.

Still referring particularly to FIGS. 9 and 10, the fourth consequential structural modification 108 of the improved cylinder head 100 involves reducing the diameter of the coolant by-pass ports 65' to an acceptable minimum so that coolant flow in the lower jacket chamber 55 is improved. By reducing the diameter of the coolant by-pass ports in the present invention, a problem was remedied with respect to the cylinder head of U.S. Pat. No. 4,860,700 (see comparison between coolant by-pass ports 65, 65' respectively of FIGS. 8 and 9), wherein an excessive amount of coolant bypassing to the upper jacket chamber from the lower jacket chamber with consequent lowering of coolant flow in the lower jacket chamber. By way of example, the coolant by-pass ports are twenty-five percent to seventy-five percent the diameter of the by-pass ports disclosed in U.S. Pat. No. 4,860,700; that is, the coolant by-pass ports 65' of the present invention have a cross-section of substantially between 0.1875 inches and 0.0625 inches, as compared to a cross-section of about 0.25 inches for the coolant by-pass ports 65 of U.S. Pat. No. 4,860,700.

Figure 5:
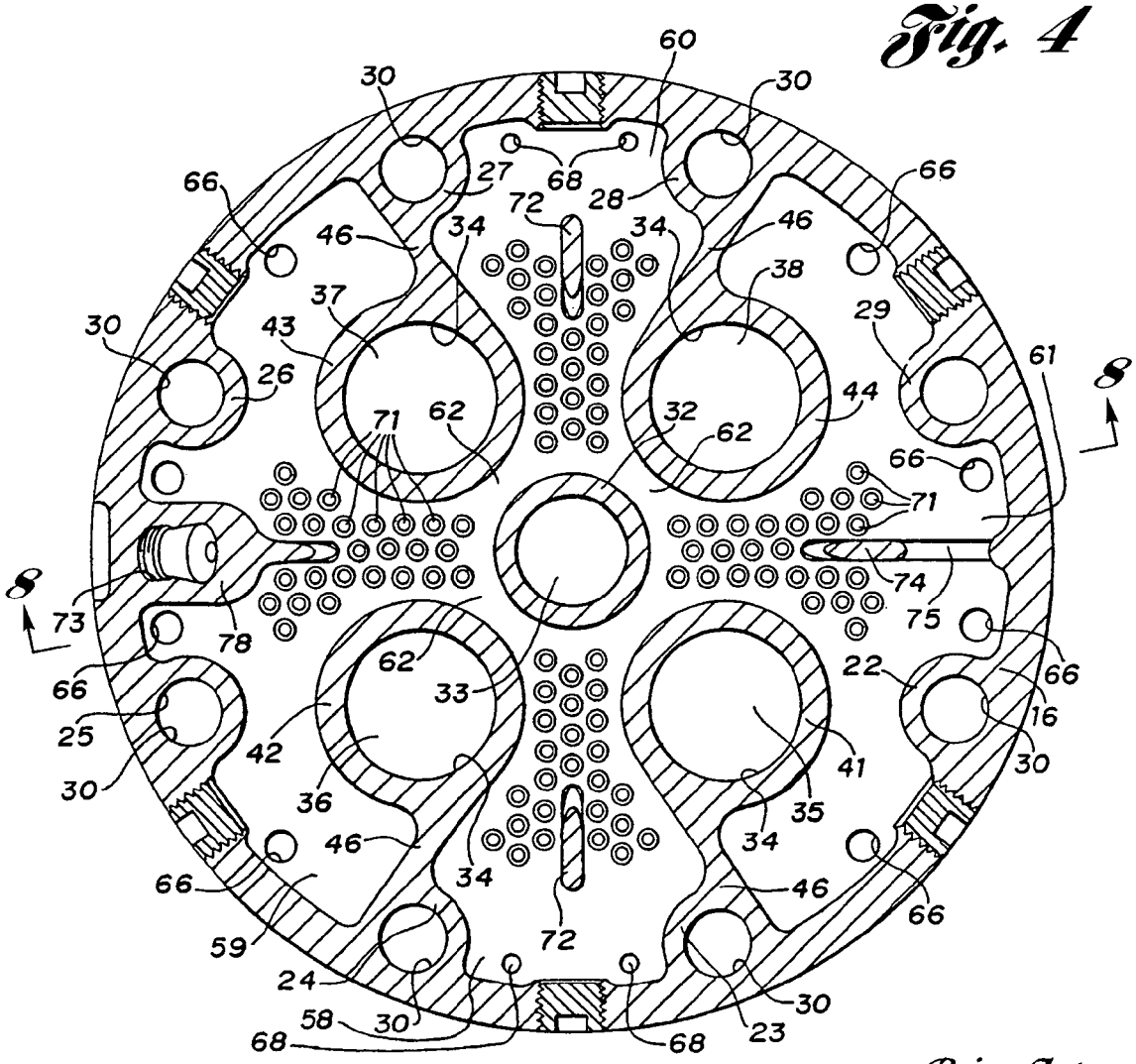
Prior Art Fig. 5
FIGS. 5, 6, and 7 are horizontal sectional views taken substantially in the planes indicated by the lines 5—5, 6—6 and 7—7 respectively of FIG. 2.
Figure 6:
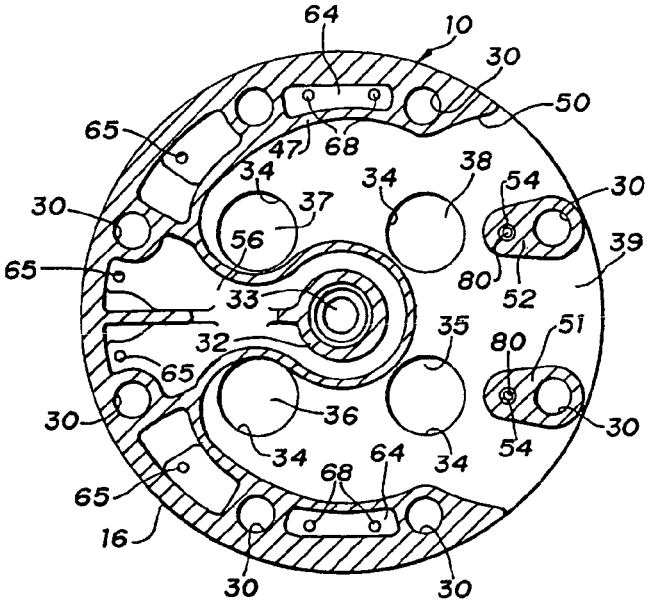
Prior Art Fig. 6
Figure 7:
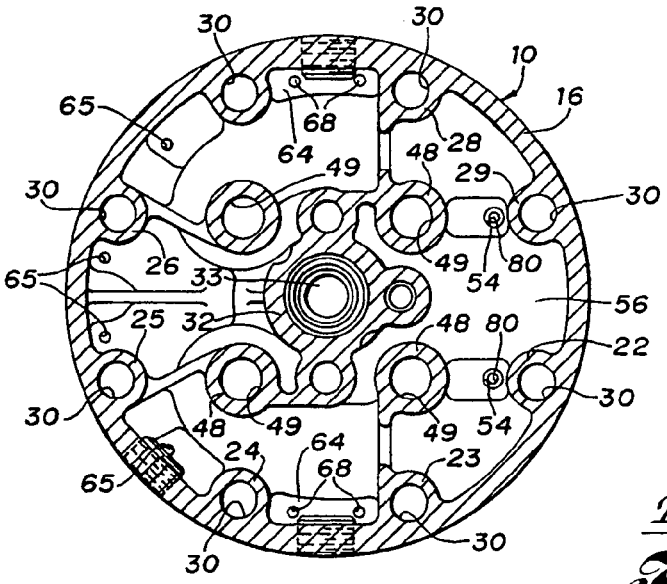
Prior Art Fig. 7

Finally, with preferential reference yet directed to FIGS. 9 and 10, the fifth consequential structural modification 110 of the improved cylinder head 100 involves the radial rib 74' being extended (or completed), wherein the opening 75 of FIG. 5 is eliminated (see comparison between FIGS. 5 and 9). By making the radial rib 74' complete, structural stiffness is improved which, in turn, provides an improvement of gasket reliability at the cylinder head to cylinder liner interface. Additionally, coolant flow is improved in the region of the completed radial rib 74'.

Figure 11:
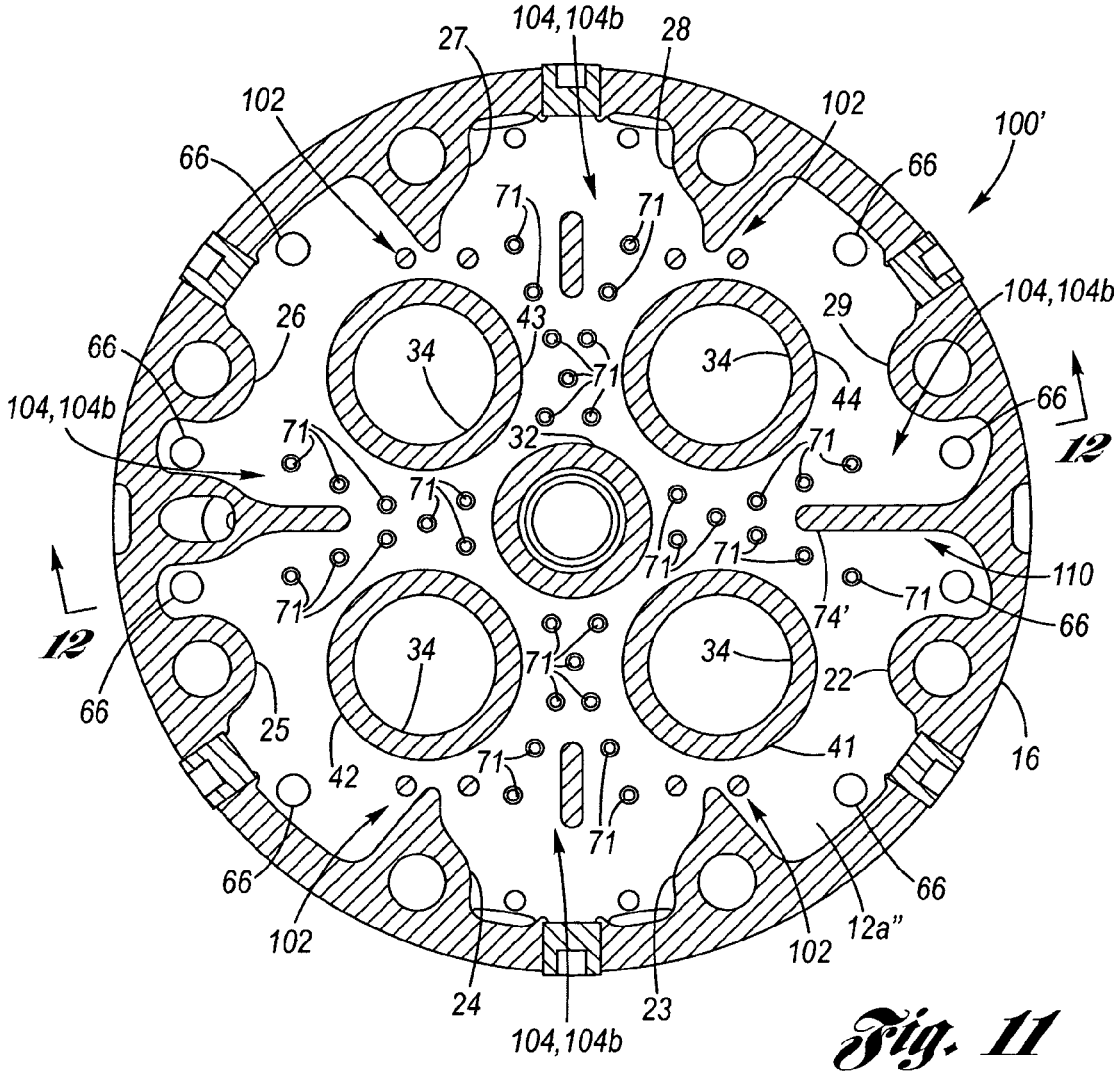
FIG. 11 is a cross-sectional view of a cylinder head according to a second preferred embodiment of the present invention.
Figure 12:
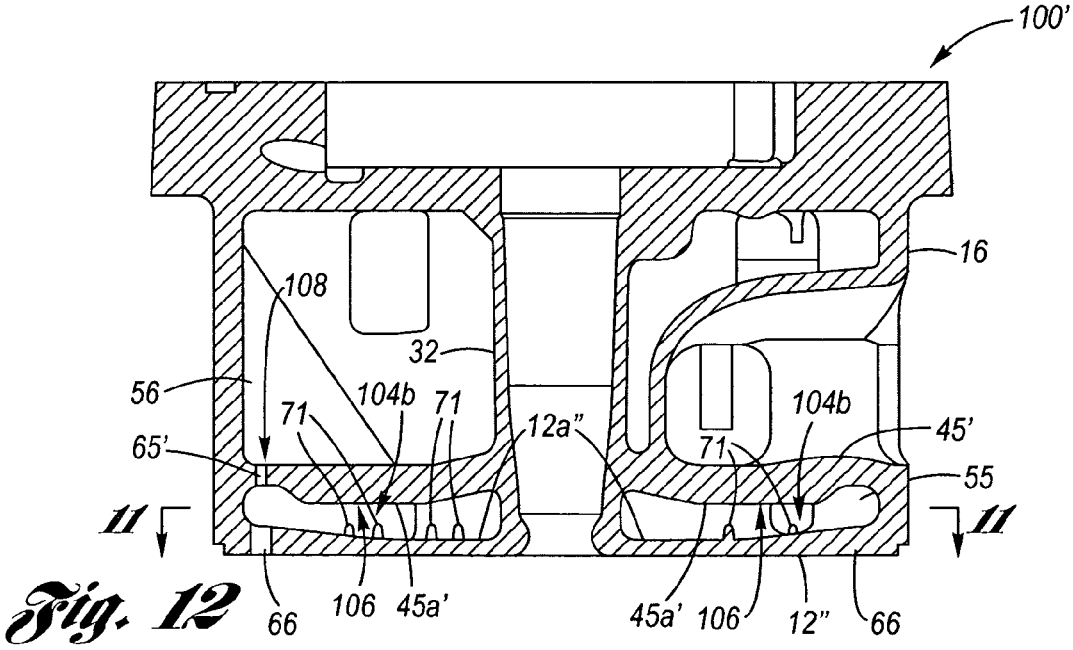
FIG. 12 is a cross-sectional view taken along line 12—12 of FIG. 11, and wherein the sectional view of FIG. 11 was taken along line 11—11 of FIG. 12.

Referring now with particular interest to FIGS. 11 and 12, a second embodiment of the improved cylinder head 100' according to the present invention is shown, wherein the aforedescribed first, third, fourth and fifth consequential modifications 102, 106, 108, 110 remain as depicted and hereinabove described, but wherein a second aspect 104*b* of the second consequential modification 104 is depicted.

Now, rather than entirely eliminating the spines (71 in FIG. 8), the spines 71 are provided on the inner fire-face wall surface 12*a",* but in a much looser (or more widely spaced) arrangement than the densely packed arrangement shown in FIGS. 5 and 8. By loosely arranging the spines 71, coolant is able to circulate therethrough, with little or no flow over, so that heat transfer from the fire-face wall to the coolant is improved over that attainable in the disclosure of U.S. Pat. No. 4,860,700. By way of example, the density of packing of the spines 71 is preferred to be between zero and fifty percent of the density of packing disclosed in U.S. Pat. No. 4,860,700; that is, in the present invention the density of the spines 71 is less than substantially five spines per square inch, wherein by way of comparison, the density of the spines for the cylinder head of U.S. Pat. No. 4,860,700 is about 9.8 spines per square inch.

Figure 13:
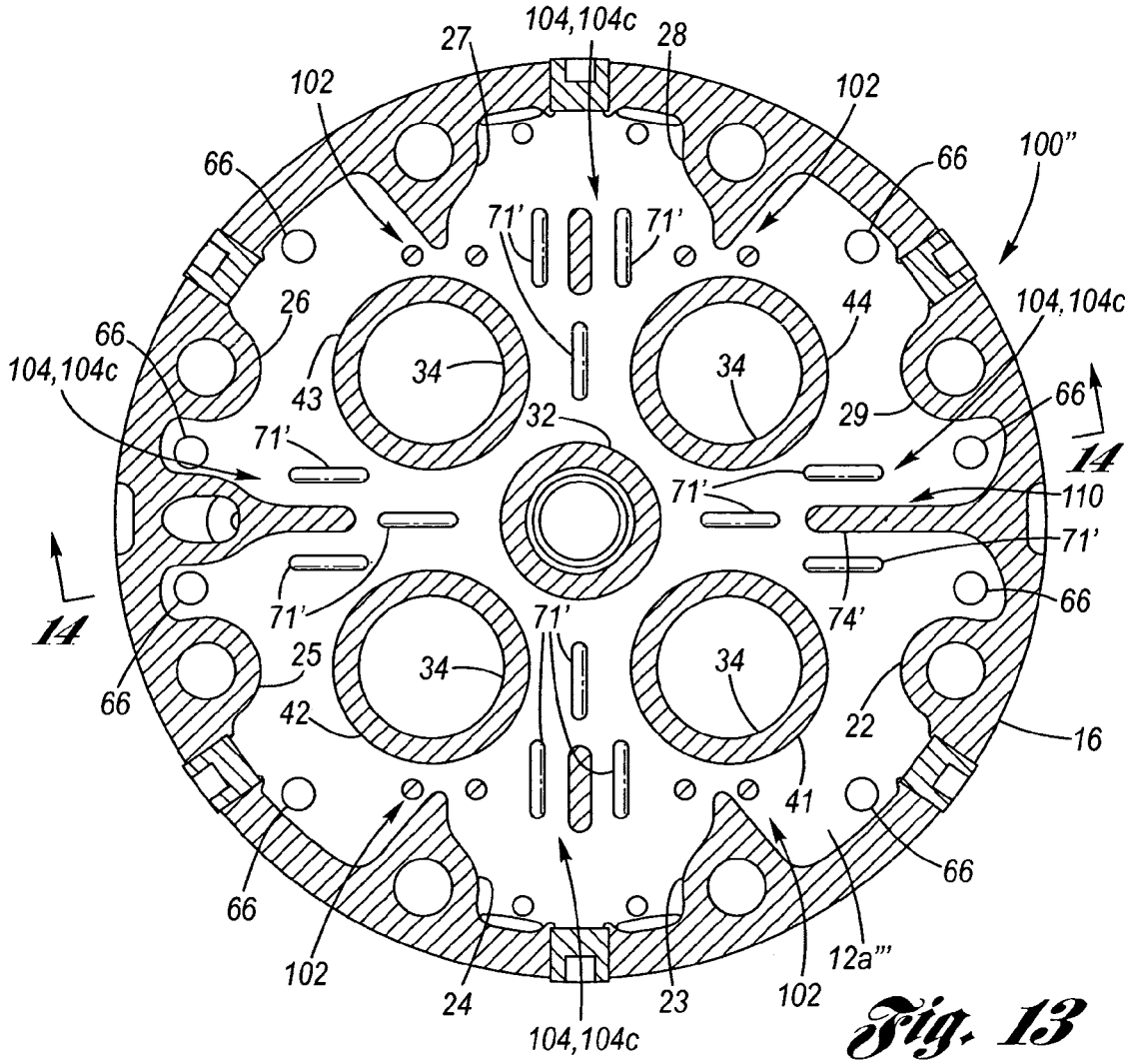
FIG. 13 is a cross-sectional view of a cylinder head according to a third preferred embodiment of the present invention.
Figure 14:
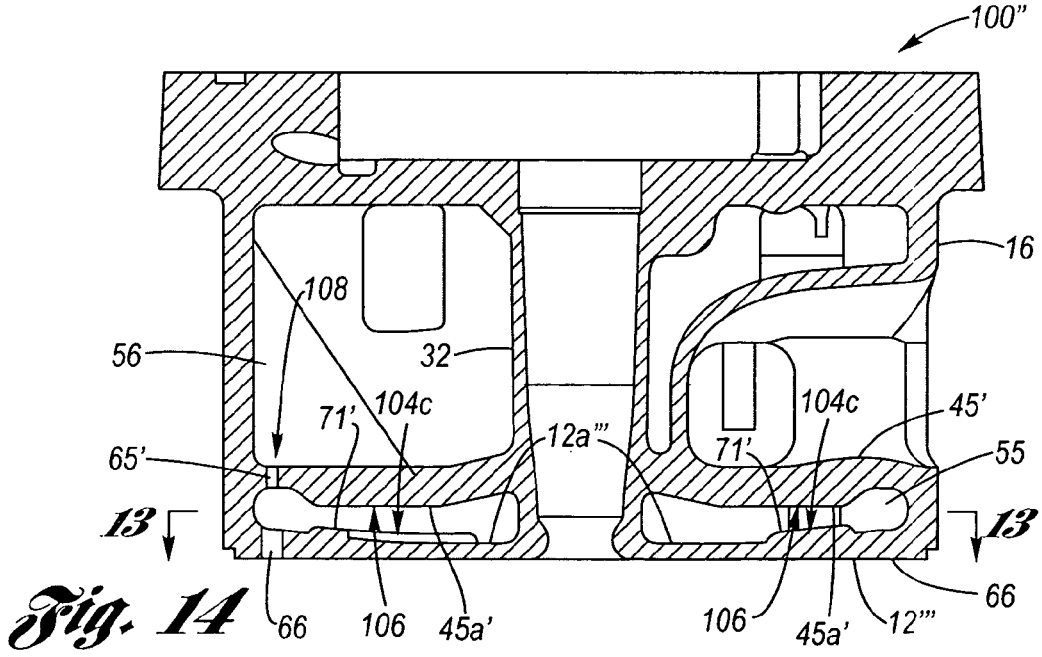
FIG. 14 is a cross-sectional view, taken along line 14—14 of FIG. 13, and wherein the sectional view of FIG. 13 was taken along line 13—13 of FIG. 14.

Referring lastly with particular direction to FIGS. 13 and 14, a third embodiment of the improved cylinder head 100" according to the present invention is shown, wherein the aforedescribed first, third, fourth and fifth consequential modifications 102, 106, 108, 110 remain as depicted and hereinabove described, but wherein a third aspect 104*c* of the second consequential modification 104 is depicted.

Now, rather than providing any spines (71 in FIG. 8), undulations 71' are provided on the inner fire-face wall surface 12*a'".* The undulations may be, for example waves (as shown) or may be dimples. In any event, the undulations 71' increase the surface area in contact with the coolant and thereby provide improved heat transfer from the fire-face wall to the coolant over that attainable in the disclosure of U.S. Pat. No. 4,860,700.

To those skilled in the art to which this invention appertains, the above described preferred embodiment may be subject to change or modification. Such change or modification can be carried out without departing from the scope of the invention, which is intended to be limited only by the scope of the appended claims.

The invention claimed is:

1. In a diesel engine cylinder head comprising:

a sidewall;

a coolant jacket within said sidewall;

a fire-face wall having an inner fire-face wall surface, said fire-face wall having a periphery connected to said sidewall;

a chamber wall extending generally parallel to said fire-face wall in substantially spaced relation thereto, said spacing being substantially 0.89 inches, said chamber wall having an inner chamber wall surface facing said inner fire-face wall surface, said fire-face wall and said chamber wall collectively dividing said coolant jacket into a lower jacket chamber and an upper jacket chamber;

a plurality of exhaust port wall portions extending through said coolant receiving jacket and embracing a portion of said fire-face wall, each exhaust port wall portion of said plurality of exhaust port wall portions defining a respective valve controllable exhaust port opening through said fire-face wall;

a plurality of stud bosses located adjacent said sidewall and in spaced relation with respect to said plurality of exhaust port wall portions;

a plurality of partition walls in said lower jacket chamber, one partition wall for each exhaust port wall portion, wherein each partition wall extends outwardly in substantially tangent relation from its respective exhaust port wall portion and connects with a respective stud boss;

a plurality of coolant inlet ports formed in said fire-face wall and opening into said lower jacket chamber adjacent a periphery thereof;

a plurality of coolant by-pass ports formed in said chamber wall fluidically connecting said lower jacket chamber to said upper jacket, said by-pass ports having a cross-section of substantially 0.25 inches;

a plurality of densely packed spines located at said inner fire-face wall surface substantially adjacent said plurality of exhaust port wall portions, wherein the spines have a density of substantially 9.8 spines per square inch; and a radial rib connected with said fire-face wall and said sidewall, said rib having a rib opening formed therein;

wherein an improvement thereto comprises:

a coolant by-pass opening formed in each partition wall adjacent its respective exhaust port wall portion;

a spine density of substantially less than five spines per square inch;

spacing said inner chamber wall surface with respect to said inner fire-face wall surface substantially between 0.75 inches and 0.25 inches;

said by-pass ports having a cross-section of substantially between 0.1875 inches and 0.0625 inches; and said radial rib extending complete and free of said rib opening.

2. The cylinder head of claim 1, further comprising a plurality of obstructions respectively adjacent each said by-pass opening of each said partition wall.

3. The cylinder head of claim 1, wherein said inner fire-face wall surface is free of said spines.

4. The cylinder head of claim 3, further comprising a plurality of obstructions respectively adjacent each said by-pass opening of each said partition wall.

5. The cylinder head of claim 3, further comprising a plurality of undulations located at said inner fire-face wall surface substantially adjacent said plurality of exhaust port wall portions.

6. The cylinder head of claim 5, further comprising a plurality of obstructions respectively adjacent each said by-pass opening of each said partition wall.

7. In a diesel engine cylinder head comprising:

a sidewall;

a coolant jacket within said sidewall;

a fire-face wall having an inner fire-face wall surface, said fire-face wall having a periphery connected to said sidewall;

a chamber wall extending generally parallel to said fire-face wall in substantially spaced relation thereto, said spacing being substantially 0.89 inches, said chamber wall having an inner chamber wall surface facing said inner fire-face wall surface, said fire-face wall and said chamber wall collectively dividing said coolant jacket into a lower jacket chamber and an upper jacket chamber;

a plurality of exhaust port wall portions extending through said coolant receiving jacket and embracing a portion of said fire-face wall, each exhaust port wall portion of said plurality of exhaust port wall portions defining a respective valve controllable exhaust port opening through said fire-face wall;

a plurality of stud bosses located adjacent said sidewall and in spaced relation with respect to said plurality of exhaust port wall portions;

a plurality of partition walls in said lower jacket chamber, one partition wall for each exhaust port wall portion, wherein each partition wall extends outwardly in substantially tangent relation from its respective exhaust port wall portion and connects with a respective stud boss;

a plurality of coolant inlet ports formed in said fire-face wall and opening into said lower jacket chamber adjacent a periphery thereof;

a plurality of coolant by-pass ports formed in said chamber wall fluidically connecting said lower jacket chamber to said upper jacket, said by-pass ports having a cross-section of substantially 0.25 inches;

a plurality of densely packed spines located at said inner fire-face wall surface substantially adjacent said plurality of exhaust port wall portions, wherein the spines have a density of substantially 9.8 spines per square inch; and a radial rib connected with said fire-face wall and said sidewall, said rib having a rib opening formed therein;

wherein an improvement thereto comprises:

a by-pass opening formed in each partition wall adjacent its respective exhaust port wall portion.

8. The cylinder head of claim 7, further comprising a plurality of obstructions respectively adjacent each said by-pass opening of each said partition wall.

9. The cylinder head of claim 7, wherein said improvement further comprises at least one of:

a spine density of substantially less than 5 spines per square inch;

spacing said inner chamber wall surface with respect to said inner fire-face wall surface substantially between 0.75 inches and 0.25 inches;

said coolant by-pass ports having a cross-section of substantially between 0.1875 inches and 0.0625 inches; and said radial rib extending complete and free of said rib opening.

10. In a diesel engine cylinder head comprising:

a sidewall;

a coolant jacket within said sidewall;

a fire-face wall having an inner fire-face wall surface, said fire-face wall having a periphery connected to said sidewall;

a chamber wall extending generally parallel to said fire-face wall in substantially spaced relation thereto, said spacing being substantially 0.89 inches, said chamber wall having an inner chamber wall surface facing said inner fire-face wall surface, said fire-face wall and said chamber wall collectively dividing said coolant jacket into a lower jacket chamber and an upper jacket chamber;

a plurality of exhaust port wall portions extending through said coolant receiving jacket and embracing a portion of said fire-face wall, each exhaust port wall portion of said plurality of exhaust port wall portions defining a respective valve controllable exhaust port opening through said fire-face wall;

a plurality of stud bosses located adjacent said sidewall and in spaced relation with respect to said plurality of exhaust port wall portions;

a plurality of partition walls in said lower jacket chamber, one partition wall for each exhaust port wall portion, wherein each partition wall extends outwardly in substantially tangent relation from its respective exhaust port wall portion and connects with a respective stud boss;

a plurality of coolant inlet ports formed in said fire-face wall and opening into said lower jacket chamber adjacent a periphery thereof;

a plurality of coolant by-pass ports formed in said chamber wall fluidically connecting said lower jacket chamber to said upper jacket, said by-pass ports having a cross-section of substantially 0.25 inches;

a plurality of densely packed spines located at said inner fire-face wall surface substantially adjacent said plurality of exhaust port wall portions, wherein the spines have a density of substantially 9.8 spines per square inch; and a radial rib connected with said fire-face wall and said sidewall, said rib having a rib opening formed therein;

wherein an improvement thereto comprises:

a spine density of less than substantially 5 spines per square inch.

11. The cylinder head of claim 10, wherein said inner fire-face wall surface is free of said spines.

12. The cylinder head of claim 11, further comprising a plurality of undulations located at said inner fire-face wall surface substantially adjacent said plurality of exhaust port wall portions.

13. The cylinder head of claim 10, wherein said improvement further comprises at least one of:

a by-pass opening formed in each partition wall adjacent its respective exhaust port wall portion;

spacing said inner chamber wall surface with respect to said inner fire-face wall surface substantially between 0.75 inches and 0.25 inches;

said coolant by-pass ports having a cross-section of substantially between 0.1875 inches and 0.0625 inches; and said radial rib extending complete and free of said rib opening.

14. In a diesel engine cylinder head comprising:

a sidewall;

a coolant jacket within said sidewall;

a fire-face wall having an inner fire-face wall surface, said fire-face wall having a periphery connected to said sidewall;

a chamber wall extending generally parallel to said fire-face wall in substantially spaced relation thereto, said spacing being substantially 0.89 inches, said chamber wall having an inner chamber wall surface facing said inner fire-face wall surface, said fire-face wall and said chamber wall collectively dividing said coolant jacket into a lower jacket chamber and an upper jacket chamber;

a plurality of exhaust port wall portions extending through said coolant receiving jacket and embracing a portion of said fire-face wall, each exhaust port wall portion of said plurality of exhaust port wall portions defining a respective valve controllable exhaust port opening through said fire-face wall;

a plurality of stud bosses located adjacent said sidewall and in spaced relation with respect to said plurality of exhaust port wall portions;

a plurality of partition walls in said lower jacket chamber, one partition wall for each exhaust port wall portion, wherein each partition wall extends outwardly in substantially tangent relation from its respective exhaust port wall portion and connects with a respective stud boss;

a plurality of coolant inlet ports formed in said fire-face wall and opening into said lower jacket chamber adjacent a periphery thereof;

a plurality of coolant by-pass ports formed in said chamber wall fluidically connecting said lower jacket chamber to said upper jacket, said by-pass ports having a cross-section of substantially 0.25 inches;

a plurality of densely packed spines located at said inner fire-face wall surface substantially adjacent said plurality of exhaust port wall portions, wherein the spines have a density of substantially 9.8 spines per square inch; and a radial rib connected with said fire-face wall and said sidewall, said rib having a rib opening formed therein;

wherein an improvement thereto comprises:

spacing said inner chamber wall surface with respect to said inner fire-face wall surface substantially between 0.75 inches and 0.0625 inches.

15. The cylinder head of claim 14, wherein said improvement further comprises at least one of:

a by-pass opening formed in each partition wall adjacent its respective exhaust port wall portion;

a spine density of less than substantially 5 spines per square inch;

said coolant by-pass ports having a cross-section of substantially between 0.1875 inches and 0.0625 inches; and said radial rib extending complete and free of said rib opening.

16. In a diesel engine cylinder head comprising:

a sidewall;

a coolant jacket within said sidewall;

a fire-face wall having an inner fire-face wall surface, said fire-face wall having a periphery connected to said sidewall;

a chamber wall extending generally parallel to said fire-face wall in substantially spaced relation thereto, said spacing being substantially 0.89 inches, said chamber wall having an inner chamber wall surface facing said inner fire-face wall surface, said fire-face wall and said chamber wall collectively dividing said coolant jacket into a lower jacket chamber and an upper jacket chamber;

a plurality of exhaust port wall portions extending through said coolant receiving jacket and embracing a portion of said fire-face wall, each exhaust port wall portion of said plurality of exhaust port wall portions defining a respective valve controllable exhaust port opening through said fire-face wall;

a plurality of stud bosses located adjacent said sidewall and in spaced relation with respect to said plurality of exhaust port wall portions;

a plurality of partition walls in said lower jacket chamber, one partition wall for each exhaust port wall portion, wherein each partition wall extends outwardly in substantially tangent relation from its respective exhaust port wall portion and connects with a respective stud boss;

a plurality of coolant inlet ports formed in said fire-face wall and opening into said lower jacket chamber adjacent a periphery thereof;

a plurality of coolant by-pass ports formed in said chamber wall fluidically connecting said lower jacket chamber to said upper jacket, said by-pass ports having a cross-section of substantially 0.25 inches;

a plurality of densely packed spines located at said inner fire-face wall surface substantially adjacent said plurality of exhaust port wall portions, wherein the spines have a density of substantially 9.8 spines per square inch; and a radial rib connected with said fire-face wall and said sidewall, said rib having a rib opening formed therein;

wherein an improvement thereto comprises:

said coolant by-pass ports having a cross-section of substantially between 0.1875 inches and 0.0625 inches.

17. The cylinder head of claim 16, wherein said improvement further comprises at least one of:

a by-pass opening formed in each partition wall adjacent its respective exhaust port wall portion;

a spine density of substantially less than 5 spines per square inch;

spacing said inner chamber wall surface with respect to said inner fire-face wall surface substantially between 0.75 inches and 0.25 inches; and said radial rib extending complete and free of said rib opening.

18. In a diesel engine cylinder head comprising:

a sidewall;

a coolant jacket within said sidewall;

a fire-face wall having an inner fire-face wall surface, said fire-face wall having a periphery connected to said sidewall;

a chamber wall extending generally parallel to said fire-face wall in substantially spaced relation thereto, said spacing being substantially 0.89 inches, said chamber wall having an inner chamber wall surface facing said inner fire-face wall surface, said fire-face wall and said chamber wall collectively dividing said coolant jacket into a lower jacket chamber and an upper jacket chamber;

a plurality of exhaust port wall portions extending through said coolant receiving jacket and embracing a portion of said fire-face wall, each exhaust port wall portion of said plurality of exhaust port wall portions defining a respective valve controllable exhaust port opening through said fire-face wall;

a plurality of stud bosses located adjacent said sidewall and in spaced relation with respect to said plurality of exhaust port wall portions;

a plurality of partition walls in said lower jacket chamber, one partition wall for each exhaust port wall portion, wherein each partition wall extends outwardly in substantially tangent relation from its respective exhaust port wall portion and connects with a respective stud boss;

a plurality of coolant inlet ports formed in said fire-face wall and opening into said lower jacket chamber adjacent a periphery thereof;

a plurality of coolant by-pass ports formed in said chamber wall fluidically connecting said lower jacket chamber to said upper jacket, said by-pass ports having a cross-section of substantially 0.25 inches;

a plurality of densely packed spines located at said inner fire-face wall surface substantially adjacent said plurality of exhaust port wall portions, wherein the spines have a density of substantially 9.8 spines per square inch; and a radial rib connected with said fire-face wall and said sidewall, said rib having a rib opening formed therein;

wherein an improvement thereto comprises:

said radial rib extending complete and free of said rib opening.

19. The cylinder head of claim 18, wherein said improvement further comprises at least one of:

a by-pass opening formed in each partition wall adjacent its respective exhaust port wall portion;

a spine density of less than substantially 5 spines per square inch;

spacing said inner chamber wall surface with respect to said inner fire-face wall surface substantially between 0.74 inches and 0.25 inches; and said coolant by-pass ports having a cross-section of substantially between 0.1875 inches and 0.0625 inches.

* * * * *